US006626651B2

(12) United States Patent
Akazawa et al.

(10) Patent No.: US 6,626,651 B2
(45) Date of Patent: Sep. 30, 2003

(54) LINEAR COMPRESSOR

(75) Inventors: Teruyuki Akazawa, Shiga (JP); Sadao Kawahara, Shiga (JP); Sugimatsu Hasegawa, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/152,587

(22) Filed: May 23, 2002

(65) Prior Publication Data

US 2002/0176790 A1 Nov. 28, 2002

(30) Foreign Application Priority Data

May 23, 2001 (JP) ..... 2001-154140

(51) Int. Cl.[7] ..... F04B 17/04; F04B 49/06

(52) U.S. Cl. ..... 417/417; 417/44.1; 417/363; 310/12

(58) Field of Search ..... 417/417, 415, 417/410.1, 363, 44.1; 310/12, 17

(56) References Cited

U.S. PATENT DOCUMENTS 3,895,281 A * 7/1975 Corbaz ..... 318/687
4,928,028 A * 5/1990 Leibovich ..... 310/23
5,040,372 A * 8/1991 Higham ..... 62/6
6,084,320 A * 7/2000 Morita et al. ..... 310/12
6,413,057 B1 * 7/2002 Hong et al. ..... 417/416

* cited by examiner

*Primary Examiner*—Cheryl J. Tyler
*Assistant Examiner*—Michael K. Gray
(74) *Attorney, Agent, or Firm*—Armstrong, Westerman & Hattori, LLP

(57) ABSTRACT

A linear compressor includes a cylinder supported in a hermetic vessel by a support mechanism. A piston is supported concentrically with the cylinder such that the piston can move in an axial direction of the cylinder. A compression chamber is formed between the cylinder and the piston. A linear motor portion has a moving member connected to the piston through a holding member. A stator is fixed to the cylinder to form a magnetic path between the stator and the moving member. The linear motor portion generates thrust for moving the piston in the axial direction. A sensor detects a displacement of the axial length center of the moving member and a DC bias current is fed to the linear motor to align the axial length of the moving member and the axial length of the stator with each other at the time of operation.

11 Claims, 3 Drawing Sheets

LINEAR COMPRESSOR

BACKGROUND OF THE INVENTION (1) Field of the Invention

The present invention relates to a linear compressor used in an air conditioner and the like for reciprocating a piston in a cylinder by a linear motor to compress gas, and more particularly, to a linear compressor in which a load is not applied, almost at all, to a direction perpendicular to a reciprocating direction of a piston.

(2) Description of the Prior Art

In refrigeration cycle, HCFC refrigerants such as R22 are stable compound and decompose the ozone layer. In recent years, HFC refrigerants begin to be utilized as alternative refrigerants of HCFCs, but these HFC refrigerants have the nature for facilitating the global warming. Therefore, a study is started to employ HC refrigerants which do not decompose the ozone layer or largely affect the global warming. However, since this HC refrigerant is flammable, it is necessary to prevent explosion or ignition so as to ensure the safety. For this purpose, it is required to reduce the amount of refrigerant to be used as small as possible. On the other hand, the HC refrigerant itself does not have lubricity and is easily melted into lubricant. For these reasons, when the HC refrigerant is used, an oilless or oil-poor compressor is required. A linear compressor in which a load applied in a direction perpendicular to an axis of its piston is small and a sliding surface pressure is small is known as a compressor which can easily realize oilless as compared with a reciprocal type compressor, a rotary compressor and a scroll compressor.

However, the linear motor used for the linear compressor has such a loss of end effect that if the piston receives a gas pressure which is being compressed, the axial length center of the moving member is deviated from the axial length center of the stator, and the thrust is lowered. If the displacement amount is further increased, a behavior of the moving member becomes unstable, and it is difficult to stably operate the linear motor.

SUMMARY OF THE INVENTION

Thereupon, it is an object of the present invention to provide an efficient and reliable linear compressor in which an axial length center of the moving member connected to a piston is previously deviated toward a compression chamber with respect to an axial length center of the stator, the axial length center of the moving member and the axial length center of the stator are substantially aligned with each other at the time of operation of the linear compressor.

It is another object of the invention to provide a reliable linear compressor in which a DC bias current is fed to a linear motor, thereby substantially aligning the axial length center of the moving member and the axial length center of the stator of the linear motor with each other at the time of operation of the linear compressor.

According to a first aspect of the present invention, there is provided a linear compressor comprises a cylinder supported in a hermetic vessel by a support mechanism, a piston which is supported concentrically with the cylinder such that the piston can move in an axial direction of the cylinder, and which forms a compression chamber between the cylinder and the piston, a spring mechanism for applying an axial force to the piston, and a linear motor portion having a moving member connected to the piston through a holding member and a stator fixed to the cylinder to form a magnetic path between the stator and the moving member, the linear motor portion generating thrust for moving the piston in its axial direction, wherein the linear compressor further comprises aligning means for aligning an axial length center of the stator and an axial length center of the moving member with each other at the time of operation.

According to a second aspect of the invention, in the linear compressor of the first aspect, the aligning means deviates the axial length center of the moving member toward the compression chamber with respect to the axial length center of the stator in expectation of a length through which the axial length center of the stator is displaced with respect to the axial length center of the moving member at the time of operation, and mounts the moving member thereon.

According to a third aspect of the invention, in the linear compressor of the second aspect, the length to be displaced is determined by a pressure fluctuation of a refrigerant gas in the compression chamber.

According to a fourth aspect of the invention, in the linear compressor of the second aspect, the length to be displaced is determined by a pressure difference between a suction pressure and a discharge pressure.

According to a fifth aspect of the invention, in the linear compressor of the first aspect, the aligning means feeds a DC bias current to the linear motor portion so that the spring mechanism receives a gas pressure to act against a displacing force of the spring mechanism.

According to a sixth aspect of the invention, in the linear compressor of the fifth aspect, the DC bias current is fed in proportion to a pressure difference between the suction pressure and the discharge pressure.

According to a seventh aspect of the invention, in the linear compressor of the fourth or sixth aspect, the suction pressure is defined as a suction pressure of a predetermined cooling condition or heating condition, and the discharge pressure is defined as a discharge pressure of a predetermined cooling condition or heating condition.

According to an eighth aspect of the invention, in the linear compressor of the fourth or sixth aspect, the suction pressure is defined as an average suction pressure between a suction pressure of a predetermined cooling condition and a suction pressure of a predetermined heating condition, and the discharge pressure is defined as an average discharge pressure between a discharge pressure of a predetermined cooling condition and a discharge pressure of a predetermined heating condition.

According to a ninth aspect of the invention, in the linear compressor of the seventh or eighth aspect, the predetermined cooling condition is set to an indoor set temperature of 27° C. and an outdoor temperature of 35° C., and the predetermined heating condition is set to an indoor set temperature of 20° C. and an outdoor temperature of 7° C.

According to a tenth aspect of the invention, there is provided a linear compressor comprises a cylinder supported in a hermetic vessel by a support mechanism, a piston which is supported concentrically with the cylinder such that the piston can move in an axial direction of the cylinder, and which forms a compression chamber between the cylinder and the piston, a spring mechanism for applying an axial force to the piston, and a linear motor portion having a moving member connected to the piston through a holding member and a stator fixed to the cylinder to form a magnetic path between the stator and the moving member, the linear motor portion generating thrust for moving the piston in its axial direction, wherein the linear compressor further comprises a position sensor for detecting a displacement of the axial length center of the moving member caused by a gas pressure.

According to a first aspect of the present invention, since the linear compressor comprises the aligning means which aligns the axial length center of the moving member with the axial length center of the stator during operation, even if the compressed gas force during operation is applied to the piston and the amplitude center of the piston is moved in a direction opposite from the compression chamber, the axial length center of the moving member and the axial length center of the stator are not largely deviated from each other and thus, the linear compressor can be driven efficiently.

According to a second aspect of the invention, in the linear compressor of the first aspect, the aligning means deviates the axial length center of the moving member toward the compression chamber with respect to the axial length center of the stator in expectation of a length through which the axial length center of the stator is displaced with respect to the axial length center of the moving member at the time of operation, and mounts the moving member thereon. With this design, the displacement can reliably be corrected, and the efficiency of the linear motor can be enhanced.

According to a third aspect of the invention, in the linear compressor of the second aspect, since a length to be displaced is determined by a pressure fluctuation of the refrigerant gas in the compression chamber, high performance can always maintained without lowering efficiency of the linear motor at the time of operation of the piston.

According to a fourth aspect of the invention, in the linear compressor of the second aspect, since the length to be displaces is determined by a difference between the suction pressure and the discharge pressure, it is possible to enhance the efficiency of the linear motor.

According to a fifth aspect of the invention, in the linear compressor of the first aspect, since the aligning means feeds a DC bias current to the linear motor portion so that the spring mechanism receives a gas pressure to act against a force which replaces the spring mechanism, the actuation of the moving member of the linear compressor is stabilized. Further, since the suction pressure oscillates in the vicinity of the neutral point, it is possible to reduce the necessary amplitude amount, and to enhance the reliability of the spring.

According to a sixth aspect of the invention, in the linear compressor of the fifth aspect, since the DC bias current is fed in proportion to a difference between the suction pressure and the discharge pressure, it is possible to precisely align the axial length center of the moving member with the axial length center of the stator and thus, it is possible to operate the moving member more stably.

According to a seventh aspect of the invention, in the linear compressor of the fourth or sixth aspect, since the suction pressure is defined as a suction pressure of the predetermined cooling condition or heating condition, and since the discharge pressure is defined as the predetermined cooling condition or heating condition, the piston receives the difference pressure between the suction pressure and the discharge pressure, and the displacement amount of the axial length center of the moving member is determined as an amount to be displaced previously, it is possible to substantially align the axial length center of the moving member with the axial length center of the stator, it is possible to enhance the efficiency of the air conditioner at the time of cooling or heating during operation.

According to an eighth aspect of the invention, in the linear compressor of the fourth or sixth aspect, the suction pressure is defined as an average suction pressure between a suction pressure of a predetermined cooling condition and a suction pressure of a predetermined heating condition, and the discharge pressure is defined as an average discharge pressure between a discharge pressure of a predetermined cooling condition and a discharge pressure of a predetermined heating condition. Therefore, a deviation amount between the axial length center of the stator and the axial length center of the moving member at the time of cooling and heating is reduced, the linear motor can be actuated efficiently, and it is possible to realize an air conditioner having high seasonal energy efficiency ratio.

According to a ninth aspect of the invention, in the linear compressor of the seventh or eighth aspect, the predetermined cooling condition is set to an indoor set temperature of 27° C. and an outdoor temperature of 35° C., and the predetermined heating condition is set to an indoor set temperature of 20° C. and an outdoor temperature of 7° C. Therefore, it is possible to reduce, during a year, a displacement amount between the axial length center of the stator and the axial length center of the moving member at the time of cooling and heating and thus, it is possible to operate the air conditioner in each mode, and to reduce power consumption to a low level.

According to a tenth aspect of the invention, a deviation of the axial length center of the moving member with respect to the axial length center of the stator, i.e., displacement of the spring mechanism is detected by a position sensor, and a DC bias current value is determined based on a detection signal of the position sensor. With this, the axial length center of the moving member which is deviated upon reception of a gas pressure during operation can precisely be aligned with the axial length center of the stator. Therefore, it is possible to stably operate the moving member of the linear compressor, and to enhance the reliability.

DESCRIPTION OF THE PREFERRED EMBODIMENTS

Figure 1:
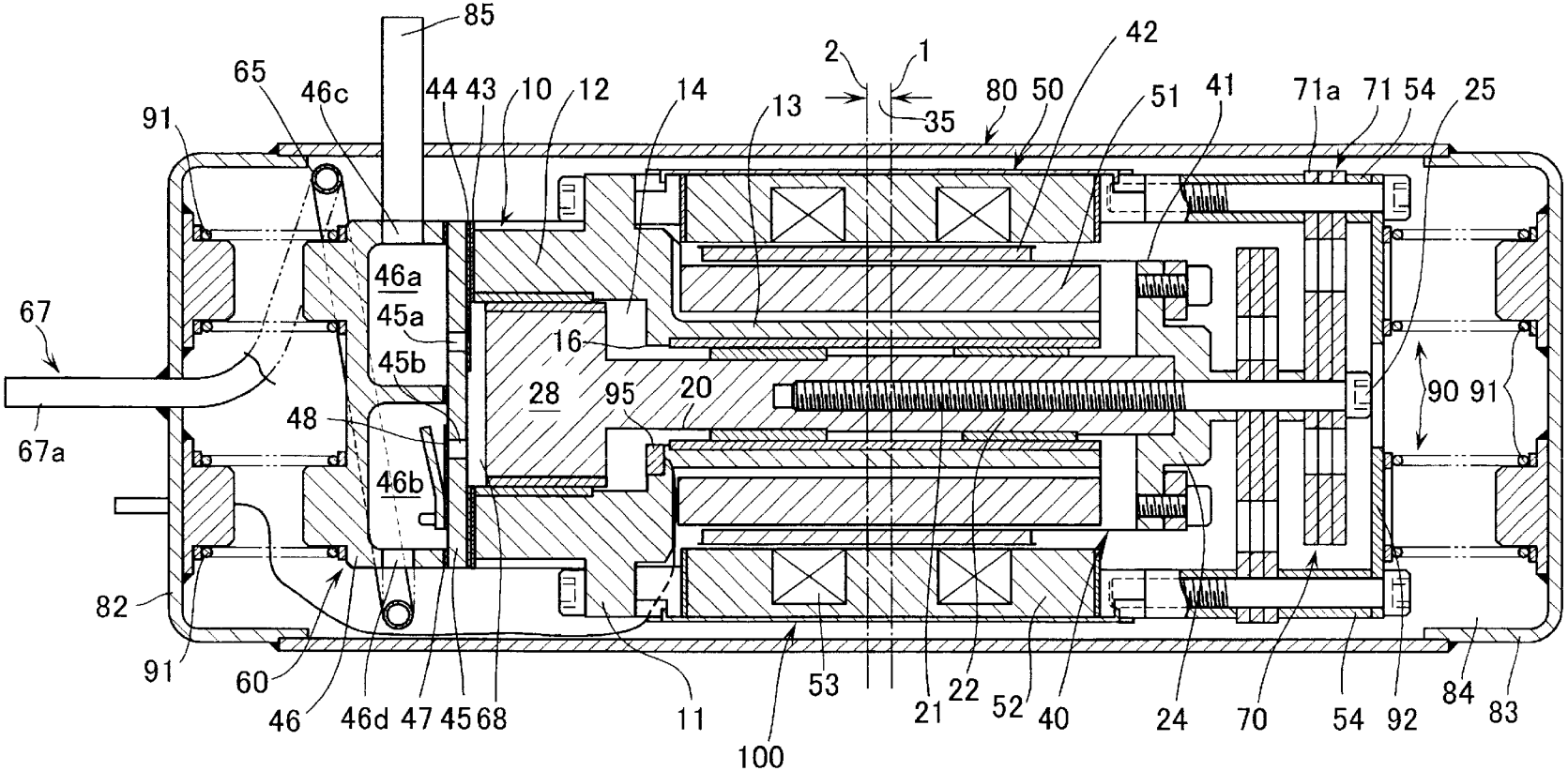
FIG. 1 is a sectional view showing an entire structure of a linear compressor according to an embodiment of the present invention.

FIG. 1 is a sectional view of a linear compressor according to an embodiment of the present invention. This linear compressor comprises a hermetic vessel 80, a cylinder portion 10 accommodated in the hermetic vessel 80, a support mechanism 90 for supporting the cylinder portion 10 in the hermetic vessel 80, a piston portion 20 supported by the cylinder portion 10 such that the piston portion 20 can move in the axial direction of the cylinder portion 10, a linear motor portion 100 having a moving member 40 and a stator 50 and generating thrust in the piston portion 20 in its axial direction by a magnetic force, and an suction/discharge mechanism 60 for sucking and discharging a refrigerant gas. The piston portion 20 is resiliently supported by a spring mechanism (spring member) 70.

The hermetic vessel 80 comprises a cylindrical vessel, and forms a space 84 therein. All of constituent parts of the linear compressor are accommodated in the space 84. The hermetic vessel 80 is provided with a suction tube 85 for introducing a refrigerant from outside of the hermetic vessel 80, and with a discharge tube 67 for discharging the refrigerant out from the hermetic vessel 80.

The support mechanism 90 comprises coil springs 91 disposed on one end side and the other end side in the hermetic vessel 80. The support mechanism 90 functions to resiliently support the cylinder portion 10 in the hermetic vessel 80, and functions to reduce the transmission of vibration from the cylinder portion 10 toward the hermetic vessel 80. The coil springs 91 disposed on the one end are interposed between a cylinder head cover 46 and a front wall plate 82 of the hermetic vessel 80. The coil springs 91 disposed on the side of the other end are interposed between a rear wall plate 83 of the hermetic vessel 80 and a support plate 92 connected to a stator 50 of the linear motor portion 100 fixed to the cylinder portion 10.

The cylinder portion 10 is integrally formed with a flange portion 11, a boss portion 12 expanding from the flange portion 11 toward the one end, and a cylindrical portion 13 extending toward the other end along an axial direction of the boss portion 12. A space 14 is formed in the boss portion 12, and the cylindrical portion 13 is formed with a cylinder bore 16 which is in communication with the space 14 and which opens toward the other end.

The piston portion 20 comprises a rod 22 forming a screw portion 21 therein, and a piston portion body 28 swelling toward one end of the rod 22. The rod 22 is movably supported in the cylinder bore 16 of the cylinder portion 10. Members for enhancing wear resistance and sealing ability are provided between the rod 22 and an inner wall surface of the cylinder bore 16 as well as between the piston portion body 28 and an inner wall surface of the space 14. A cylinder head 45 is fixed to a front end of the boss portion 12 of the cylinder portion 10. A compression chamber 68 is formed in a boss portion 12 between a front end of the piston portion body 28 and the cylinder head 45. A bolt 25 is threadedly engaged with a screw portion 21 in the piston portion 20. A flange 24 is fixed to the other end of the rod 22.

The linear motor portion 100 comprises the moving member 40 and the stator 50 as described above. The moving member 40 comprises a cylindrical holding member 41 and a permanent magnet 42 fixed to an outer periphery of the cylindrical holding member 41. The other end of the cylindrical holding member 41 is fixed to the flange 24. Therefore, the cylindrical holding member 41 and the piston portion 20 are connected to each other. On the other hand, the stator 50 comprises an inner yoke 51, an outer yoke 52 and coils 53. The inner yoke 51 comprises a cylindrical body, and is fitted into an outer periphery of the cylindrical portion 13 of the cylinder portion 10, and is fixed to the boss portion 12 such that the inner yoke 51 is circumscribing the boss portion 12. A fine gap is formed between an outer peripheral surface of the inner yoke 51 and an inner peripheral surface of the cylindrical holding member 41 of the moving member 40. The outer yoke 52 also comprises a cylindrical body, a circumferential surface thereof is fixed to the flange portion 11 of the cylinder portion 10 in a state in which a fine gap between the outer yoke 52 and an outer peripheral surface of the permanent magnet 42 of the moving member 40 is maintained. Each of the coils 53 is fixed to the outer yoke 52, and is disposed at a position opposed to the permanent magnet 42. A support body 54 for fixing a support plate 92 is fixed to the other end of the outer yoke 52. The inner yoke 51, the outer yoke 52 and the moving member 40 are held precisely concentrically.

Next, the suction/discharge mechanism 60 will be explained.

The suction/discharge mechanism 60 comprises a cylinder head 45, a cylinder head cover 46 fixed to the cylinder head 45, a suction tube 85 and a discharge tube 67 which are connected to the cylinder head cover 46. The cylinder head 45 is fixed to an end of the boss portion 12 through a seal member 43, and forms a suction port 45*a* and a discharge port 45*b* which are in communication with the compression chamber 68. A suction valve 44 is provided on the suction port 45*a* on the side of the compression chamber 68, and a discharge valve 48 is provided on the discharge port 45*b* on the other side from the compression chamber 68.

In this embodiment, the cylinder head cover 46 is integrally formed and a low pressure chamber 46*a* and a high pressure chamber 46*b* are defined in the cylinder head cover 46, and the cylinder head cover 46 is fixed to the cylinder head 45 through a seal member 47. The low pressure chamber 46*a* is in communication with the suction port 45*a*, and the high pressure chamber 46*b* is in communication with the discharge port 45*b*. A suction hole 46*c* for bringing the low pressure chamber 46*a* and the suction tube 85 into communication with each other is provided on the side of the low pressure chamber 46*a*. A discharge hole 46*d* for bringing the high pressure chamber 46*b* and the discharge tube 67 into communication with each other is provided on the side of the high pressure chamber 46*b*.

The suction tube 85 projects out from the hermetic vessel 80. On the other hand, the discharge tube 67 comprises a discharge tube body 67*a* projecting from the hermetic vessel 80, and a spiral discharge tube 65 which is connected to the discharge tube body 67*a* and which is connected to the discharge hole 46*d* of the cylinder head cover 46. As shown in the drawing, the spiral discharge tube 65 is formed by spirally bending a pipe member, and a portion of the discharge tube 65 is wound around an outer peripheral space of the cylinder head cover 46.

The spring mechanism 70 comprises a plurality of (two sets in the drawing) flat plate-like spring plates 71 disposed on the other end side of the piston portion 20. The spring plates 71 are provided between the bolt 25 threaded into the piston portion 20 and the support body 54 fixed to the cylinder portion 10. Each spring plate 71 comprises a plurality of superposed spring plate members 71*a*.

Next, operation of the linear compressor of the embodiment will be explained.

First, if the coil 53 of the stator 50 is energized, magnetic force, i.e., thrust which is proportional to the current is generated between the permanent magnet 42 of the moving member 40 and the coil 53 in accordance with Fleming's left-hand rule. A driving force is applied to the moving member 40 for moving the moving member 40 in its axial direction by this thrust. Since the cylindrical holding member 41 of the moving member 40 is connected to the spring mechanism 70, the piston 20 moves. Here, the coil 53 is energized with sine wave, thrust in normal direction and thrust in the reverse direction are alternately generated in the linear motor. By the alternately generated thrust in the normal direction and thrust in the reverse direction, the piston 20 reciprocates.

Figure 2:
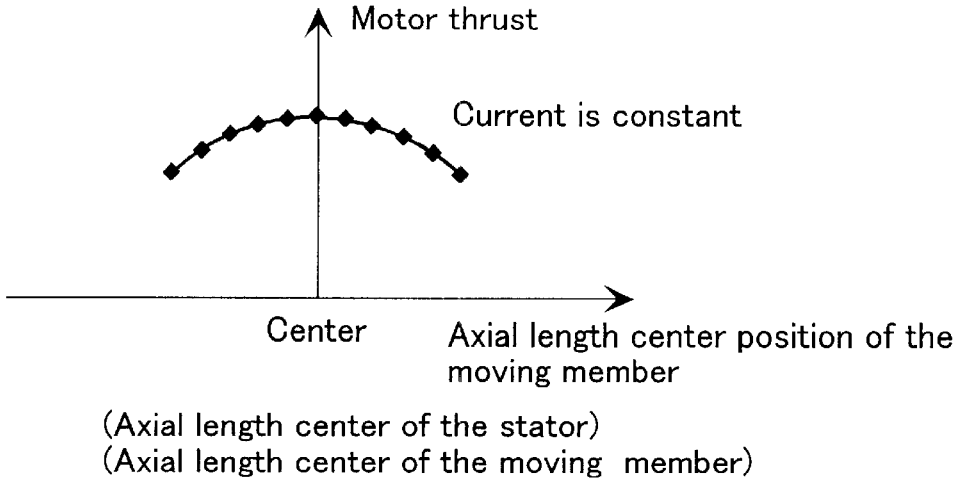
FIG. 2 is an explanatory view showing characteristics of the linear motor of the invention.

FIG. 2 shows characteristics of the linear motor, and shows motor thrust when a current value fed to the linear motor is kept at a constant value. In FIG. 2, a horizontal axis shows an axial direction of the moving member, and a vertical axis shows a motor thrust. In FIG. 2, a center indicates an aligned point between an axial length center 2 of the moving member and an axial length center 1 of the stator. There is a tendency that the axial length center 2 of the moving member is displaced and deviated from the axial length center 1 of the stator at the time of actuation of the linear motor. If this displacement is generated, a loss of end effect of the linear motor is generated and the thrust is lowered. Therefore, in order to actuate the linear motor efficiently, it is necessary to substantially align the axial length center 2 of the moving member 40 with the axial length center 1 of the stator at the time of actuation of the linear motor 100. For this reason, it is necessary to provide aligning means for aligning the axial length center 1 of the stator and the axial length center 2 of the moving member with each other at the time of operation of the linear compressor.

The refrigerant gas is introduced into the hermetic vessel 80 from the suction tube 85. The introduced refrigerant gas is sucked into the low pressure chamber 46*a* from the suction tube 85 in the hermetic vessel 80, passes through the suction valve 44 and enters into the compression chamber 68. Then, the refrigerant gas is compressed by the piston portion 20, passed through the discharge valve 48 assembled into the discharge port 45*b* of the cylinder head 45, passes through the high pressure chamber 46*b* and is discharged from the discharge tube 67.

At the time of actuation of the linear motor, the piston portion body 28 receives a gas pressure of the compressed gas as the refrigerant gas is compressed, and the vibration center of the moving member 40 is displaced in a direction opposite from the compression chamber 68. This displacement amount is defined as a deviation amount 35, and the axial length center 2 of the moving member is deviated and assembled toward the compression chamber 68 at a position corresponding to the deviation amount 35 with respect to the axial length center 1 of the stator. With this, even if an amplitude center of the piston portion 20 is moved in the direction opposite from the compression chamber 68 during operation of the linear compressor, since the deviation amount of the axial length center 2 of the moving member from the axial length center 1 of the stator is not increased, the compressor can be operated efficiently.

The deviation amount 35 is a displacement amount of the axial length center 2 of the moving member caused by a pressure difference between a suction pressure in the suction tube 85, the hermetic vessel 80, the low pressure chamber 46*a* and the like, and a discharge pressure in the high pressure chamber 46*b*, the discharge tube 67 and the like. Therefore, since the axial length center 2 of the moving member is substantially aligned with the axial length center 1 of the stator during operation of the compressor and the linear motor can be actuated, the efficiency of the linear motor is enhanced. The suction pressure is defined as a suction pressure value of a predetermined cooling condition or heating condition, and the discharge pressure is defined as a discharge pressure value of a predetermined cooling condition or heating condition. An amount determined by a pressure difference between the suction pressure and the discharge pressure is defined as an amount to previously deviate the displacement amount of the axial length center 2 of the moving member. Therefore, since the axial length center 2 of the moving member can substantially be aligned with the axial length center 1 of the stator, the efficiency of the air conditioner can be enhanced.

The predetermined cooling condition is defined as a first suction pressure and a first discharge pressure of the linear compressor determined from an indoor set temperature of 27° C. and an outdoor temperature of 35° C. The predetermined heating condition is defined as a second suction pressure and a second discharge pressure of the linear compressor determined from an indoor setting temperature of 20° C. and an outdoor temperature of 7° C. A pressure difference between the average suction pressure and the average discharge pressure respectively determined from the first and second suction pressure and discharge pressure is defined as a set deviation amount 35 as the deviation amount and thus, it is possible to operate the air conditioner in each mode, and to reduce power consumption of the air conditioner to a low level.

Figure 3:
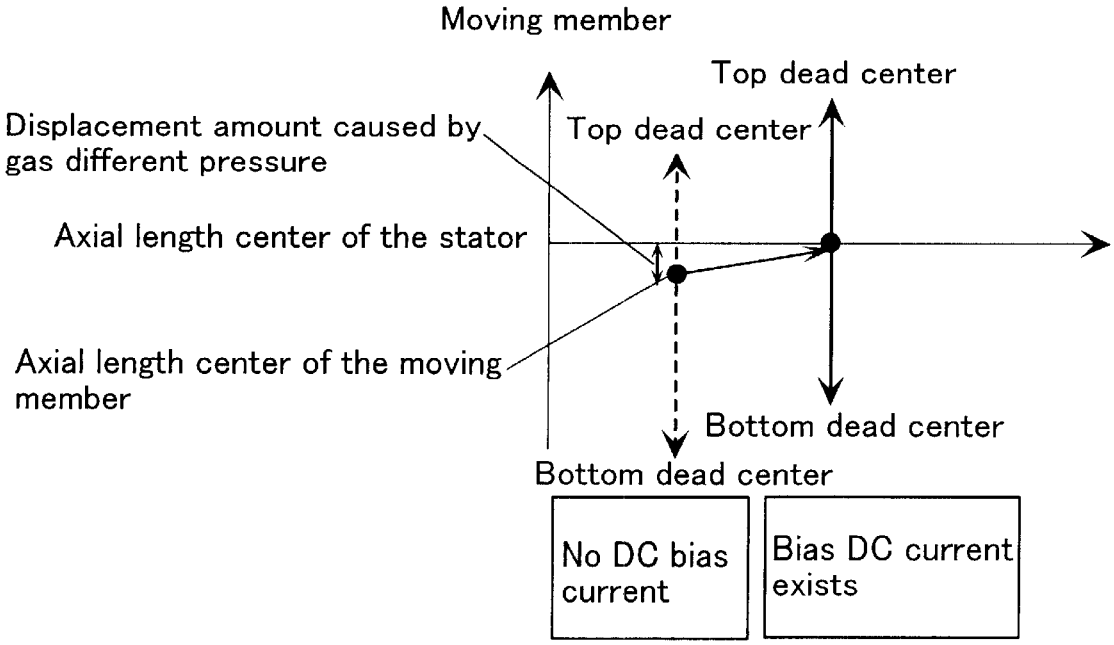
FIG. 3 is a schematic diagram showing a motion of a moving member by a DC bias current of the invention.
Figure 4:
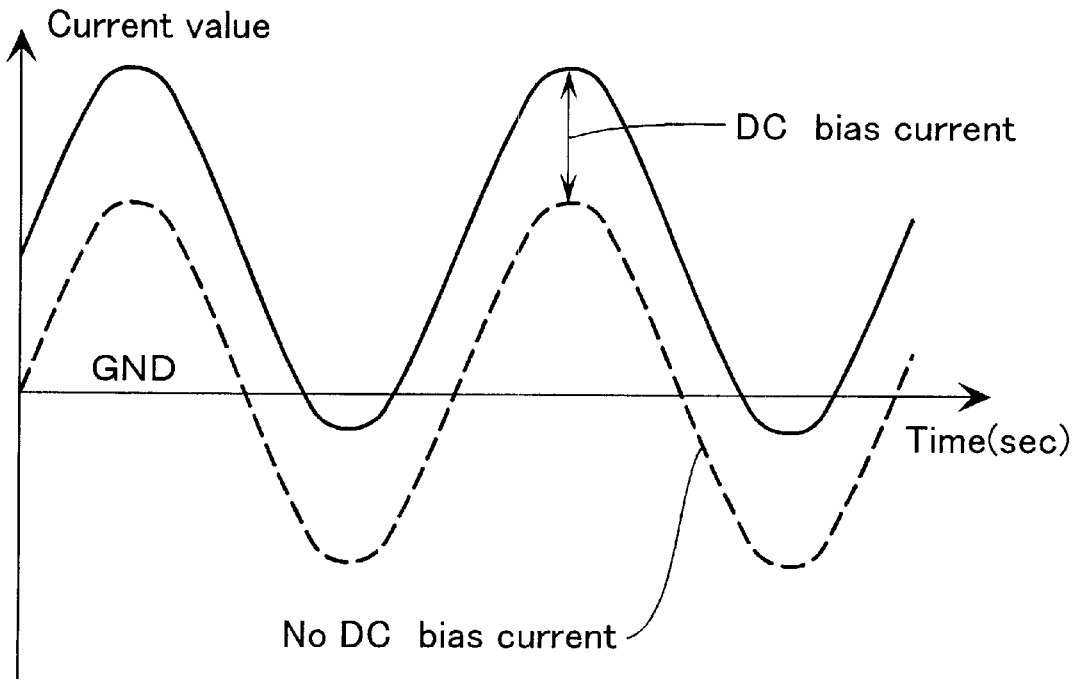
FIG. 4 is an explanatory view showing a waveform of a DC bias current of an embodiment of the invention.

Even when the spring mechanism 70 receives a gas pressure and a DC bias current which acts against a force to displace the spring mechanism 70 is fed to the linear motor, the thrust is generated toward the compression chamber 68, and the axial length center 2 of the moving member can substantially be aligned with the axial length center 1 of the stator during operation of the linear compressor. FIG. 3 is a schematic diagram showing a motion of the moving member. In FIG. 3, if a gas pressure difference is applied to the piston, an axial length center of the moving member 40 is displaced and deviated with respect to an axial length center of the stator 50 by an amount corresponding to the gas pressure difference. Thereupon, as shown in FIG. 4, the displacement can be corrected by applying a DC bias current to the linear motor. In this manner, the axial length center of the moving member 40 and the axial length center of the stator 50 can substantially be aligned with each other. In this manner, the actuation of the moving member 40 of the linear compressor can be stabilized.

Since the linear motor can be operated in the vicinity of a neutral point of the spring mechanism 70 during operation, it is possible to reduce a necessary amplitude amount of the piston portion 20. The displacement of the axial length center 2 of the moving member caused by the gas pressure is detected by a position sensor 95, and a DC bias current value can be determined by a detection signal of the position sensor 95. Therefore, it is always possible to align the axial length center 2 of the moving member with the axial length center 1 of the stator more precisely and thus, the moving member 40 can be operated stably and the reliability is enhanced. The position sensor 95 is mounted to a portion of the cylindrical portion 13 facing the compression chamber.

By detecting the suction pressure and the discharge pressure of the linear compressor and by feeding, to the linear motor, a DC bias current value which is proportional to a difference between the suction pressure and the discharge pressure, the DC bias current value is adjusted during operation, and it is possible to more precisely align the axial length center 2 of the moving member with the axial length center 1 of the stator, and the behavior of the moving member 40 can be stabilized. The vibration of the cylinder portion 10 caused by reciprocating motion of the piston portion 20 is restrained by the plurality of coil springs 91.

According to the present invention, since the linear compressor comprises the aligning means which aligns the axial length center of the moving member with the axial length center of the stator during operation, even if the compressed gas force during operation is applied to the piston and the amplitude center of the piston is moved in a direction opposite from the compression chamber, the axial length center of the moving member and the axial length center of the stator are not largely deviated from each other and thus, the linear compressor can be driven efficiently.

Further, according to the invention, the aligning means deviates the axial length center of the moving member toward the compression chamber with respect to the axial length center of the stator in expectation of a length through which the axial length center of the stator is displaced with respect to the axial length center of the moving member at the time of operation, and mounts the moving member thereon. With this, it is possible to reliably correct the displacement and to enhance the efficiency of the linear motor.

Further, according to the invention, since a length to be displaced is determined by a pressure fluctuation of the refrigerant gas in the compression chamber, high performance can always maintained without lowering efficiency of the linear motor at the time of operation of the piston.

Further, according to the invention, since the length to be displaces is determined by a difference between the suction pressure and the discharge pressure, it is possible to enhance the efficiency of the linear motor.

Further, according to the invention, DC bias current is fed to the linear motor mechanism, displacement caused by a gas pressure of the spring mechanism is eliminated, thereby stabilizing the actuation of the linear compressor. Further, since the spring mechanism oscillates in the vicinity of the neutral point, it is possible to reduce the necessary amplitude amount, and to enhance the reliability of the spring.

Further, according to the invention, since the DC bias current is fed in proportion to a difference between the suction pressure and the discharge pressure, it is possible to precisely align the axial length center of the moving member with the axial length center of the stator and thus, it is possible to operate the moving member more stably.

Further, according to the invention, since the suction pressure is defined as a suction pressure of the predetermined cooling condition or heating condition, and since the discharge pressure is defined as the predetermined cooling condition or heating condition, the piston receives the difference pressure between the suction pressure and the discharge pressure, and the displacement amount of the axial length center of the moving member becomes an amount to be displaced previously, it is possible to substantially align the axial length center of the moving member with the axial length center of the stator, it is possible to enhance the efficiency of the air conditioner.

Further, according to the invention, the suction pressure is defined as an average suction pressure between a suction pressure of a predetermined cooling condition and a suction pressure of a predetermined heating condition, and the discharge pressure is defined as an average discharge pressure between a discharge pressure of a predetermined cooling condition and a discharge pressure of a predetermined heating condition. Therefore, a deviation amount between the axial length center of the stator and the axial length center of the moving member at the time of cooling and heating is reduced, the linear motor can be actuated efficiently, and it is possible to realize an air conditioner having high seasonal energy efficiency ratio.

Further, according to the invention, the predetermined cooling condition is set to an indoor set temperature of 27° C. and an outdoor temperature of 35° C., and the predetermined heating condition is set to an indoor set temperature of 20° C. and an outdoor temperature of 7° C. Therefore, it is possible to reduce a year-round displacement amount between the axial length center of the stator and the axial length center of the moving member at the time of cooling and heating and thus, it is possible to operate the air conditioner in each mode, and to reduce power consumption to a low level.

Further, according to the invention, a deviation of the axial length center of the moving member with respect to the axial length center of the stator, i.e., displacement of the spring mechanism is detected by a position sensor, and a DC bias current value is determined based on a detection signal of the position sensor. With this, the axial length center of the moving member which is deviated upon reception of a gas pressure during operation can precisely be aligned with the axial length center of the stator. Therefore, it is possible to stably operate the moving member of the linear compressor, and to enhance the reliability.

What is claimed is:

1. A linear compressor comprises a cylinder supported in a hermetic vessel by a support mechanism, a piston which is supported concentrically with said cylinder such that said piston can move in an axial direction of said cylinder, and which forms a compression chamber between said cylinder and said piston, a spring mechanism for applying an axial force to said piston, and a linear motor portion having a moving member connected to said piston through a holding member and a stator fixed to said cylinder to form a magnetic path between the stator and said moving member, said linear motor portion generating thrust for moving said piston in its axial direction, wherein said linear compressor further comprises aligning means for aligning an axial length center of said stator and an axial length center of said moving member with each other at the time of operation of said linear compressor.

2. A linear compressor according to claim 1, wherein said aligning means deviates the axial length center of the moving member toward said compression chamber with respect to the axial length center of the stator in expectation of a length through which the axial length center of the stator is displaced with respect to the axial length center of the moving member at the time of operation, and mounts said moving member thereon.

3. A linear compressor according to claim 2, wherein said length to be displaced is determined by a pressure fluctuation of a refrigerant gas in said compression chamber.

4. A linear compressor according to claim 2, wherein said length to be displaced is determined by a pressure difference between a suction pressure and a discharge pressure.

5. A linear compressor according to claim 1, wherein said aligning means feeds a DC bias current to said linear motor portion so that said spring mechanism receives a gas pressure to act against a displacing force of said spring mechanism.

6. A linear compressor according to claim 5, wherein said DC bias current is fed in proportion to a pressure difference between the suction pressure and the discharge pressure.

7. A linear compressor according to claim 4 or 6, wherein the suction pressure is defined as a suction pressure of a predetermined cooling condition or heating condition, and the discharge pressure is defined as a discharge pressure of a predetermined cooling condition or heating condition.

8. A linear compressor according to claim 4 or 6, wherein the suction pressure is defined as an average suction pressure between a suction pressure of a predetermined cooling condition and a suction pressure of a predetermined heating condition, and the discharge pressure is defined as an average discharge pressure between a discharge pressure of a predetermined cooling condition and a discharge pressure of a predetermined heating condition.

9. A linear compressor according to claim 7, wherein the predetermined cooling condition is set to an indoor set temperature of 27° C. and an outdoor temperature of 35° C., and the predetermined heating condition is set to an indoor set temperature of 20° C. and an outdoor temperature of 7° C.

10. A linear compressor according to claim 8, wherein the predetermined cooling condition is set to an indoor set temperature of 27° C. and an outdoor temperature of 35° C., and the predetermined heating condition is set to an indoor set temperature of 20° C. and an outdoor temperature of 7° C.

11. A linear compressor comprises a cylinder supported in a hermetic vessel by a support mechanism, a piston which is supported concentrically with said cylinder such that said piston can move in an axial direction of said cylinder, and which forms a compression chamber between said cylinder and said piston, a spring mechanism for applying an axial force to said piston, and a linear motor portion having a moving member connected to said piston through a holding member and a stator fixed to said cylinder to form a magnetic path between the stator and said moving member, said linear motor portion generating thrust for moving said piston in its axial direction, wherein said linear compressor further comprises a position sensor for detecting a displacement of the axial length center of the moving member caused by a gas pressure.

* * * * *